US007178690B2

(12) United States Patent
Chasid et al.

(10) Patent No.: US 7,178,690 B2
(45) Date of Patent: Feb. 20, 2007

(54) TISSUE DISPENSING COVER

(75) Inventors: Shlomit Chasid, Mazkeret Batya (IL); Uri Zaidman, Tel Aviv (IL)

(73) Assignee: Albaad Massuot Yitzhak Ltd, Massuot Yitzhak (IL)

( * ) Notice: Subject to any disclaimer, the term of this patent is extended or adjusted under 35 U.S.C. 154(b) by 293 days.

(21) Appl. No.: 10/700,341

(22) Filed: Nov. 4, 2003

(65) Prior Publication Data

US 2005/0092764 A1 May 5, 2005

(51) Int. Cl.
*B65H 1/00* (2006.01)

(52) U.S. Cl. ..... 221/62; 221/61; 221/63

(58) Field of Classification Search ..... 221/63, 221/303, 48, 50, 45, 62, 61, 306; 206/449, 206/812, 494

See application file for complete search history.

(56) References Cited

U.S. PATENT DOCUMENTS 3,836,044 A * 9/1974 Tilp et al. ..... 221/55
3,982,659 A * 9/1976 Ross ..... 221/63
4,526,291 A * 7/1985 Margulies ..... 221/63
4,535,912 A * 8/1985 Bonk ..... 221/46
5,516,001 A 5/1996 Muckenfuhs et al.
5,542,568 A 8/1996 Julius ..... 221/63
6,206,221 B1 3/2001 Bando et al. ..... 220/254.5
6,299,017 B1 10/2001 Hill
6,382,476 B1 * 5/2002 Randall et al. ..... 222/545
6,394,298 B1 * 5/2002 Zaidman ..... 220/259.1
6,499,626 B1 * 12/2002 Julius ..... 221/63
6,729,498 B2 5/2004 Yelton et al. ..... 221/63
6,766,919 B2 * 7/2004 Huang et al. ..... 221/63
6,910,579 B2 * 6/2005 Reinke et al. ..... 206/494

* cited by examiner

*Primary Examiner*—Gene O. Crawford
*Assistant Examiner*—Timothy Waggoner
(74) *Attorney, Agent, or Firm*—The Nath Law Group; Jerald L. Meyer; Derek Richmond

(57) ABSTRACT

A cover and a dispenser for a tissue package, said dispenser comprising a tissue dispensing aperture and a manipulating opening, both opening into a tissue-containing space of the package. The tissue dispensing aperture is sized for dispensing one tissue at a time while separating a duty tissue from a successive tissue; and the manipulating opening is normally closed by a flap and is deformable to allow introduction of a user's fingers into the tissue-containing space, and wherein said tissue dispensing aperture and the manipulating opening are coverable.

30 Claims, 3 Drawing Sheets

TISSUE DISPENSING COVER

FIELD OF THE INVENTION

This invention relates to a dispensing cover for a tissue dispenser. More particularly the invention is concerned with so called 'sequential dispensers' for dispensing articles which are provided as individual interleaved or separably connected sheets and can pop-up above the top of the dispenser opening when the preceding article is removed.

BACKGROUND OF THE INVENTION

Dispensers for articles such as tissues are well known in the art. Such articles may be supplied dry or soaked/impregnated in liquid or lotion e.g. a cleaning agent, a solvent, a skin treating preparation, etc. Typically tissues have a generally rectangular shape and are supplied as separably connected sheets or interleaved, discrete sheets stacked in a variety of different configurations, to facilitate the so-called pop-up effect, where each tissue has a leading portion that is first to pass through the opening, and a trailing portion that later passes through the opening i.e. a leading tissue removed from a package drags a leading edge of a sequential tissue into a standby position so it extends at a convenient removal position.

Most containers for such articles typically are in soft-pack form or in box form, i.e. in the shape of a parallelepiped or cylindrical (e.g. in the case of separably connected tissues in a reel). In a pop-up dispenser, a leading tissue (may also referred to as a first tissue or a standby tissue) usually extends through an opening of the dispenser into an elevation above that of the dispenser. The user grasps the exposed, leading portion of the leading tissue, without the necessity of inserting fingers through the opening.

A common arrangement is to provide a narrow dispensing opening through which the tissues are pulled, one at a time, by the user. The narrow opening has two main purposes:

A. At an interleaved arrangement, the trailing portion of a first tissue to be dispensed overlaps the leading portion of the next tissue to be dispensed. As the first tissue is withdrawn by the user, the leading portion of the next tissue is pulled through the opening, for later dispensing. The tissues are folded against one another in a variety of configurations so that the friction of the trailing portion of the withdrawn sheet against the succeeding sheet pulls the leading portion of the succeeding sheet through the opening. A narrow opening is thus required to give rise to sufficient friction force to ensure separating of the interleaved sheets.

A narrow gap at a dispensing opening for separably connected sheets, is required for effective separation of the sheets, i.e. tearing along a perforation line. At times, facing edges of the dispensing opening are pointed, to improve separation of the sheets.

B. In case of moisturized tissues the narrow opening may further serve to squeeze the tissues as they are retracted through the dispenser opening, to thereby ensure that the tissues are not dripping-wet and further to retain sufficient liquid in the package.

At an initial position of a tissue package, of any of the above types, the leading edge of the first tissue is disposed within the package and it is necessary to introduce the leading edge through the narrow passage of the dispensing opening. This is also the case where a refill tissue pack is introduced into the package/container and also if for some reason the leading edge of the first tissue detaches from the grabbing dispensing opening and falls back into the package.

One problem frequently encountered in pop-up dispensing packages of the prior art is that the opening through which the tissue is dispensed must be large enough to allow the consumer to reach his or her fingers therethrough to grasp the tissue and begin the pop-up dispensing process. However, as herein above mentioned, the opening must be small enough to constrict the tissues dispensed therethrough, so that a tissue may be separated from succeeding tissues.

According to some arrangements a narrow dispensing opening is provided by means of two or more flaps projecting towards each other, leaving an interstice therebetween, where the surfaces may be deformed to allow a user to introduce his/her fingers there through, so as to pull the leading edge of the first tissue. This however, is inconvenient and may even result in injury of the users fingers.

Other arrangements are disclosed in some U.S. Patents, for example:

U.S. Pat. No. 5,516,001 discloses a dispensing opening having a large aperture and an arcuately shaped smaller aperture which are spaced apart and connected by an isthmic connection. Tissues may be easily withdrawn by the user through the large aperture, and fed through the isthmic connection to small aperture. Thereafter, the tissues may be dispensed through the small aperture in a pop-up mode.

U.S. Pat. No. 6,499,626 discloses a dispensing element including at least one larger aperture and a smaller aperture entirely separated from one another. A closure or lid can usefully be incorporated whereby the articles may easily be reached from above the top surface of the dispenser through the larger aperture, and fed through from underneath the top surface to the small aperture. Thereafter, the articles may be dispensed through the small aperture, e.g., in a pop-up mode. The arrangement of the elements is conducive to one-handed dispensing of articles from the dispenser.

U.S. Pat. No. 6,299,017 discloses a dispensing face for a dispensing unit wherein the dispensing face comprises lateral outer edges and longitudinal outer edges and not less than two orifices. The first orifice and the second orifice are coplanar, the second orifice being independent of the first orifice and being disposed at a distance not greater than 20 millimeters from the first orifice.

U.S. Pat. No. 4,526,291 discloses a lid selectively movable between a first position covering at least a portion of the top and a second position removed from the top. The lid includes a first portion adapted to cover the dispensing opening when the lid is in the first position thereof and a second portion adapted to cover the slit when the lid is in the first position thereof. The second portion of the lid is integrally but flexibly connected to the first portion of the lid, such that when the lid is in the first position thereof the second portion of the lid may be selectively pivoted with respect to the first portion of the lid away from the top, thereby to uncover the slit.

It is an object of the present invention to provide a dispenser for pop-up tissues comprising a small tissue dispensing aperture and a normally closed manipulating aperture whereby a user's fingers may be introduced through said manipulating aperture to have access to the tissues within the package and for introducing a leading edge of the first tissue through the tissue dispensing aperture.

SUMMARY OF THE INVENTION

The invention according to one of its embodiments calls for a dispenser for a tissue package, said dispenser comprising a tissue dispensing aperture and a manipulating opening, both opening into a tissue-containing space of the package; said tissue dispensing aperture is sized for dispensing one tissue at a time while separating a duty tissue from a successive tissue; wherein said manipulating opening is normally closed by a flap and is deformable to allow introduction of a user's fingers into the tissue-containing space, and wherein said tissue dispensing aperture and the manipulating opening are coverable.

According to another aspect of the invention there is provided a tissue package (of any type) fitted with a dispenser of the above type, and according to still another aspect of the invention there is provided a tissue package cover fitted with a dispenser of the above referred to type.

The primary object of the invention is to provide a tissue dispenser fitted with a tissue dispensing aperture designed to facilitate dispensing of one tissue at a time, and a manipulating opening which is normally covered/closed by a flap which is easily deformable to facilitate introduction of a user's fingers into the tissues received within the package, so as to grab a leading edge of the duty tissue (i.e. a tissue first to be dispensed in a so called 'pop-up' manner) and introduce it through the tissue dispensing aperture. This is required each time a new lot of tissues are placed in the package or incase the duty tissue disengages from the tissue dispensing aperture and drops into the package. However, at a normal state the manipulating is covered to eliminate/reduce evaporation of moisture from the tissues.

A variety of modifications are possible, all of which fall within the scope of the present invention. Examples of such modifications are:

- The shape and position of the tissue dispensing aperture may vary and it may be formed with different friction enhancing arrangements.
- The manipulating opening may be covered with one or two (or more) flaps, the shape, size and operation of which may differ. For example, the flap may be liftable or depressible; the flap may be deformable towards or away from the tissue dispensing opening, etc.
- The lid covering the tissue dispensing aperture and the manipulating opening may assume different shapes and may be opened/closed in a variety of different ways.

BRIEF DESCRIPTION OF THE DRAWINGS

In order to understand the invention and to see how it may be carried out in practice, some embodiments will now be described, by way of non-limiting examples only, with reference to the accompanying drawings, in which.

DETAILED DESCRIPTION OF THE INVENTION

Figure 1A:
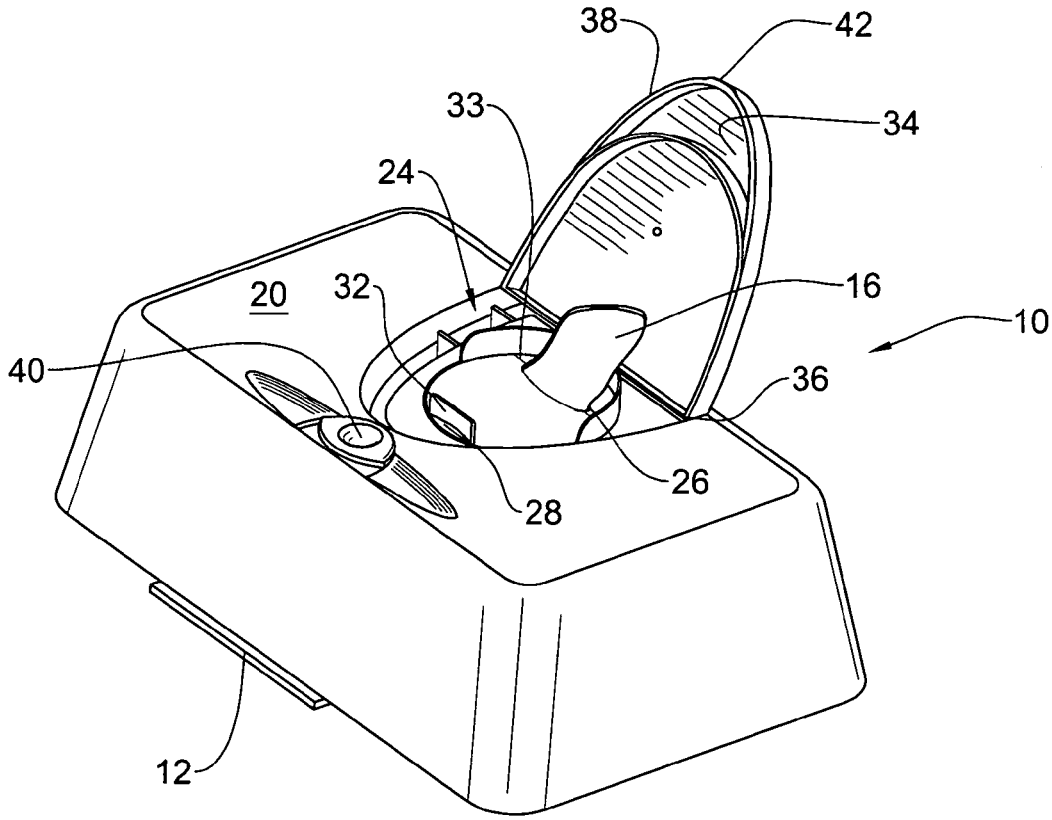
FIG. 1A is a perspective view of a tissue box integrally fitted with a dispensing cover according to an embodiment of the present invention, the lid in its open position and a leading edge of a stand-by tissue projecting through the tissue dispensing aperture.

In FIG. 1A there is illustrated a tissue container generally designated 10 which in the present embodiment is a rigid container, made for example of plastic material fitted at a bottom thereof with an openable cover 12 for introducing a pack of tissues for pop-up dispensing Thus tissues may be separate tissues arranged in a interleaved manner or in a zig-zagging pattern separately connected to one another about a perforated tear line.

The arrangement with such tissues is that upon pulling a leading edge 16 of a standby tissue (by using the term "standby tissue" is referred to a first tissue in a pack of tissues which is to be removed from the container). The standby tissue is then withdrawn through a dispensing opening of the container whilst it detaches from the sequential tissue which becomes in turn a duty tissue with its leading edge 16 now projecting from a dispensing opening of the container.

Figure 1B:
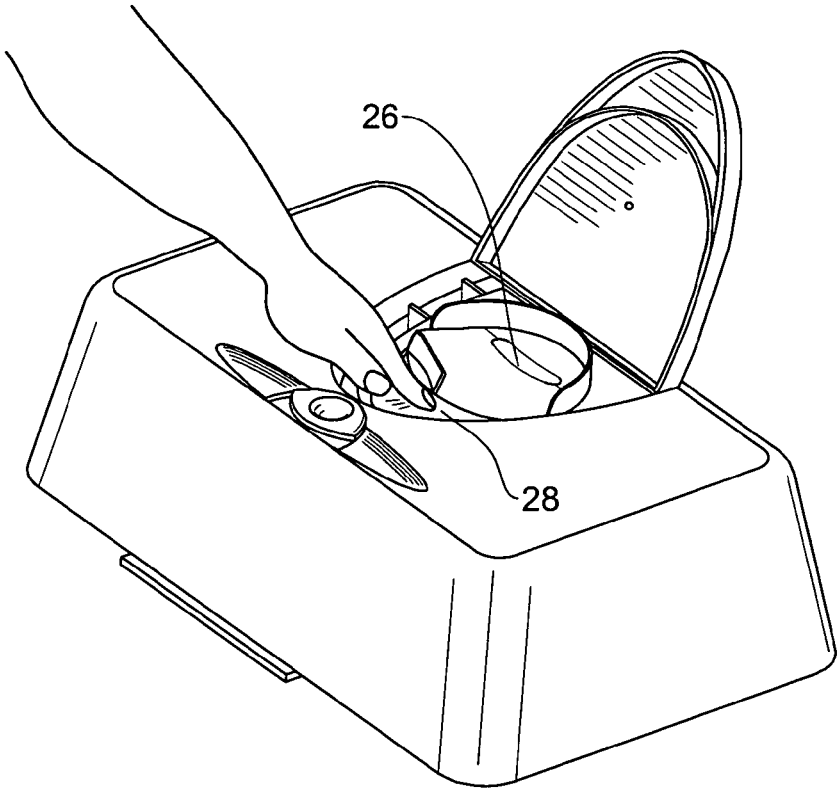
FIG. 1B illustrates a user's fingers introduced through the manipulating opening of the cover seen in FIG. 1.

Reverting now to the embodiment of FIGS. 1A and 1B, the package 10 is formed at its top face 20 with a dispenser generally designated 24 comprising a tissue dispensing aperture 26 which is in the form of a narrow arcuate slit and a manipulating opening 28 normally covered by a flap 30 extending thereover. Flap 30 is fitted at a free end thereof with a pulling tab 32 to facilitate easy grabbing by one hand for deforming the flap 30.

Cover flap 30 is integrally molded with the entire dispenser 24 and is deformable about a so-called 'integral hinge' at 33. According to another embodiment (not shown), the hinge may be a non-integral hinge, i.e. a pivot hinge.

A lid 34 is hingedly connected at 36 to the top portion 20 of the container, said lid being displaceable between an open position as in FIGS. 1A and 1B and a closed position (not seen) where it sealingly covers both the tissue dispensing aperture 26 and the manipulating opening 28 whereby sealing may be obtained, e.g. by a peripheral rim 38.

Opening and closing of the lid 34 may be facilitated, for example, by a depressible locking member 40 engageable with a latch 42 at a for end of the lid 34 whereupon depressing the locking member 40 lid 34 snaps into the open position by means of a biasing member (not shown), as known per se in the art.

It is appreciated that at an initial state, the tissue dispensing aperture 26 and the entire manipulating opening 28 may be further provided with a removable sealing patch to retain moist and liquid within the container and also useful as a temper proof seal and evidence.

In the illustrated embodiments the arrangement is such that at the closed position of lid 34 there is a gap formed between the tissue dispensing aperture 26 and the lid, so as to allow sufficient space for the projecting leading edge 16 of the duty tissue.

At an initial stage upon purchasing a tissue package, the tissues are usually in a sealed package received within the tissue pack or are provided attached thereto or as refill packs, whereby it is required to introduce the leading edge 16 of the duty tissue through the tissue dispensing aperture 26. This procedure would also be required if for some reason the leading edge 16 would disengage from the tissue dispensing aperture 26 and would fall into the space below within the package. In either of these instances, it is thus possible to deform the flap 30 by pulling at tab 32 whereby a user's fingers may be introduced into the manipulating opening 28 as illustrated in FIG. 1B for grabbing the leading edge of a duty tissue and introducing it through the tissue dispensing aperture 26.

Figure 2:
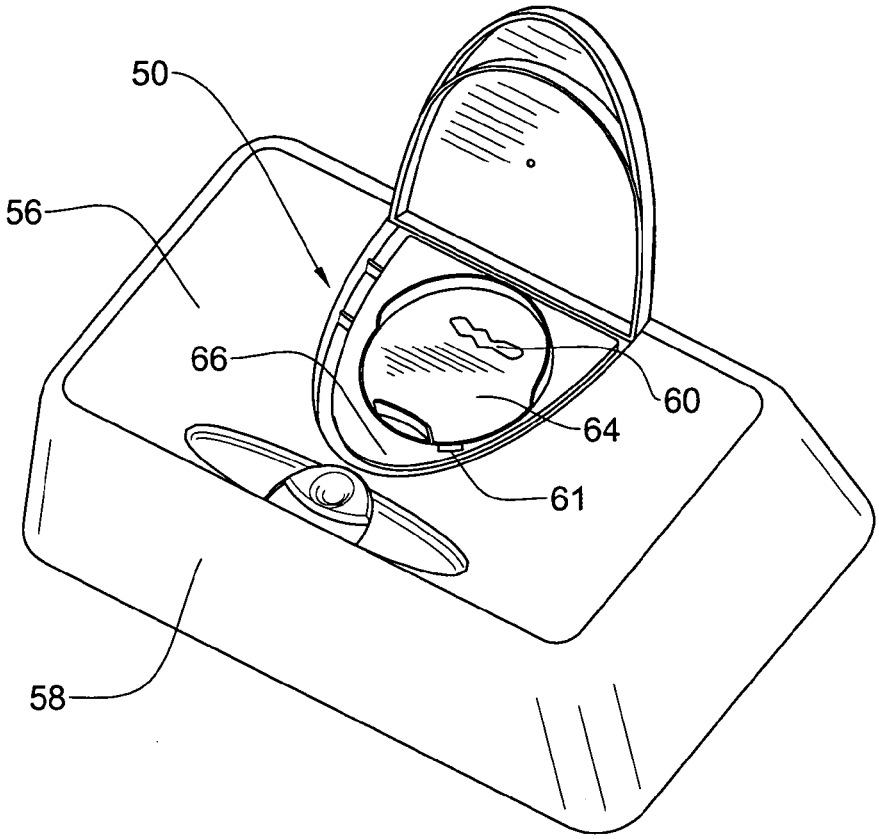
FIG. 2 illustrates a tissue box fitted with cover which in turn is fitted with tissue dispenser according to an embodiment of the present invention.

Turning now to FIG. 2, there is illustrated a modification of the invention wherein the tissue dispenser generally designated 50 is integrally formed on a tissue box cover 56 mountable on a tissue box 58. In the embodiment of FIG. 2 the tissue dispensing aperture 60 is formed with friction enhancing means which in the present example is a narrow zig-zagging slot thereby ensuring improved grip of the leading edge (not shown) which on the one hand improves separation between a duty tissue and a following proceeding tissue and, on the other hand, reduces the likelihood for the leading edge to fall through the tissue dispensing aperture 60.

Whilst the arrangement of FIG. 2 illustrates a dispenser according to the invention as an integral part of a cover for a rigid tissue container, other embodiments are possible as well such as applying a dispenser to a disposable flexible tissue pack, (not shown) e.g. by adhering same to the package.

Attention is further directed to rip 61 which is illustrated in dashed lines since at the normally closed position of the flap 64 said rip 61 extends under a peripheral edge 66 of the manipulating opening. The rip 61 serves to prevent unintentional deformation of the flap 64 upon pulling a tissue through the tissue dispensing opening 60.

Figure 3A:
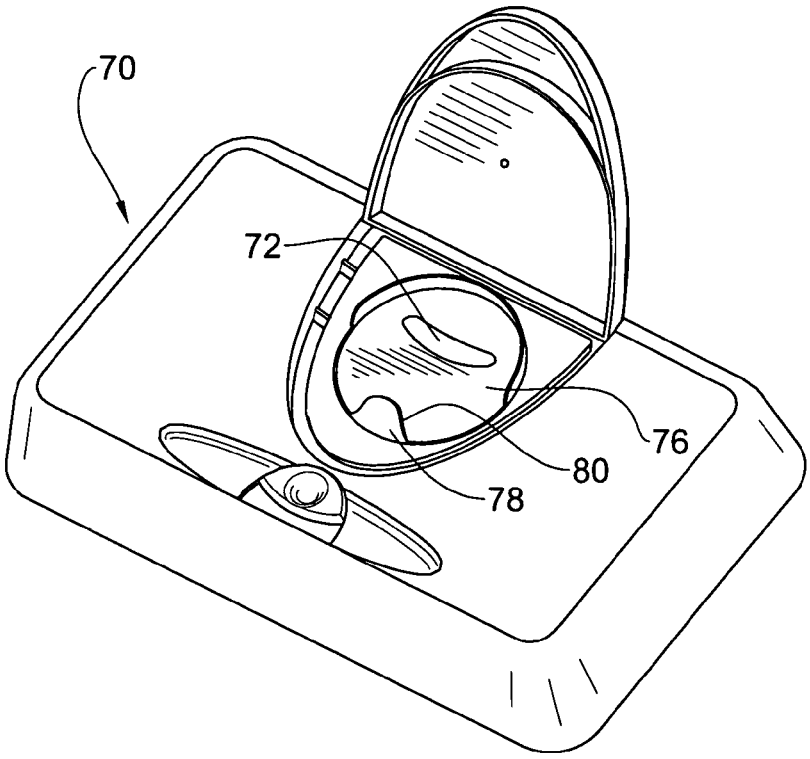
FIGS. 3A to 3C are perspective views of tissue box covers, each fitted with a tissue dispenser according to other embodiments of the present invention.
Figure 3B:
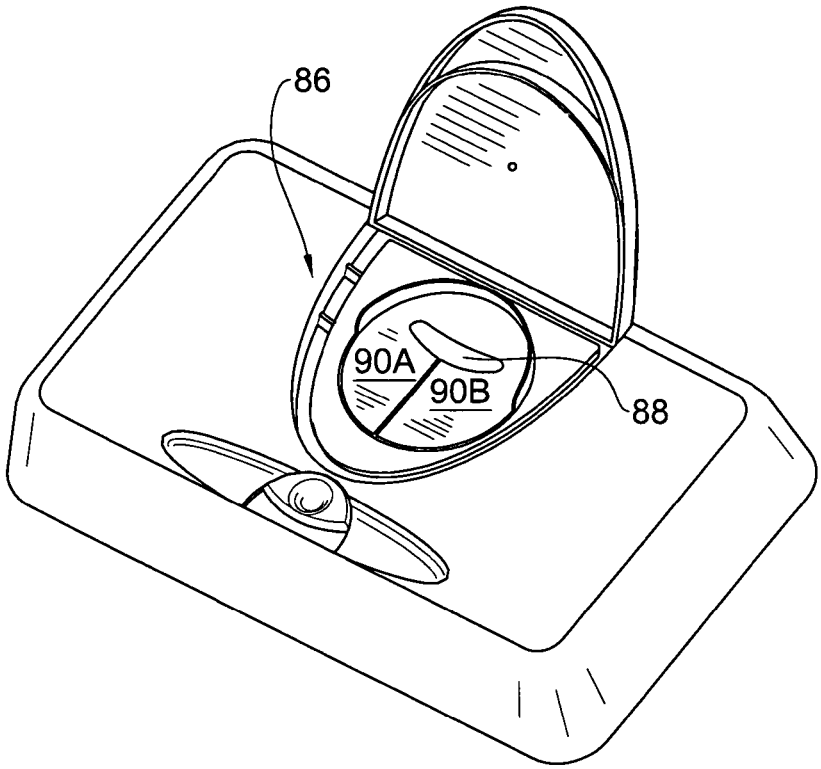
Figure 3C:
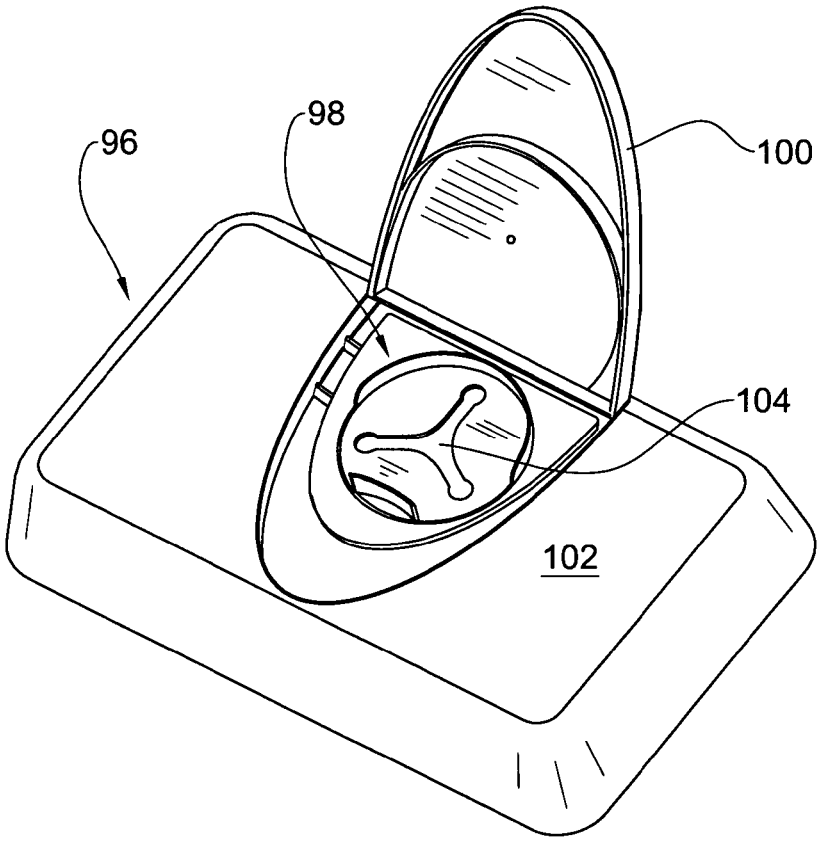

Turning now to FIGS. 3A–3C there are illustrated modifications of a dispensing cover in accordance with the present invention. In FIG. 3A, the dispensing cover generally designated 70 is similar to the previous embodiment of FIG. 2, however, the tissue dispensing aperture 72 is formed on the deformable portion of the flap 76 covering the manipulating opening 78 and further, rather than a pulling tab as in the previous embodiments, there is provided a depression (or a recess) at 80, whereby the flap 76 may be deformed to expose the opening 78 for introduction of a user's finger.

Turning now to FIG. 3B, there is illustrated a different modification whereby the dispenser 86 comprises a tissue dispensing opening aperture 88 and a manipulating opening covered by two flaps 90A and 90B extending towards one another, typically being deformable to expose the manipulating opening by depression into the space of the tissue box (not shown).

This arrangement however, is more likely to be used in conjunction with a rigid tissue box.

In the embodiments of FIG. 3C, there is illustrated a dispensing cover 96 wherein the dispenser 98 is similar to the embodiment of FIG. 1, however, the lid 100 extends over a major portion of the cover 102 and is manually displaced into the open position as in FIG. 3C. it is further noted that the tissue dispensing aperture 104 is in the shape of an inverted Y-like shape.

Whilst some embodiments have been described and illustrated with reference to some drawings, the artisan will appreciate that many variations are possible which do not depart from the general scope of the invention, mutatis, mutandis.

The invention claimed is:

1. A dispenser for a tissue package, said dispenser comprising a tissue dispensing aperture and a manipulating opening different from said dispensing aperture, both opening into a tissue-containing space of the package;

said tissue dispensing aperture is sized for dispensing one tissue at a time while separating a duty tissue from a successive tissue; and further comprising at least one flap for normally closing said manipulating opening while maintaining open said dispensing aperture, and for selectively opening the manipulation opening to allow introduction of a user's fingers into the tissue-containing space, wherein at least a portion of said dispensing aperture is comprised on the or each said flap, wherein the or each said flap is hinged by hinged portions extending at sides of the tissue dispensing aperture, and wherein said tissue dispensing aperture and the manipulating opening are coverable.

2. A dispenser according to claim 1, wherein the tissue dispensing aperture and the manipulating opening are coverable, by a re-closable lid.

3. A dispenser according to claim 2, wherein the tissue dispensing aperture is spaced apart from the lid, so as to accommodate a portion of a duty tissue.

4. A dispenser according to claim 1, wherein the entire tissue dispensing aperture is formed on the flap of the manipulating opening.

5. A dispenser according to claim 1, wherein the flap is rigid.

6. A dispenser according to claim 1, wherein the flap is hinged to the dispenser by an integral hinge.

7. A dispenser according to claim 1, wherein the flap is rigid though pliable.

8. A dispenser according to claim 1, wherein the flap is fitted with a pulling tab.

9. A dispenser according to claim 1, wherein the flap is fitted with a pulling recess.

10. A dispenser according to claim 9, wherein the tissue dispensing aperture constitutes the pulling recess.

11. A dispenser according to claim 1, attached to a surface of a disposable tissue package.

12. A dispenser according to claim 2, wherein the lid is arrested in a closed state thereof by a depressible a locking member, and whereby depressing the locking member results disengages the lid to spring into an open position and remain in this position.

13. A dispenser according to claim 1, wherein the tissue dispensing aperture is fitted with friction arrangements to enhance engagement with a tissue projecting there through.

14. A dispenser according to claim 13, wherein the friction arrangements are in the form of projections into a path of the aperture.

15. A dispenser according to claim 13, wherein the friction arrangements are in the form of undulants of a path of the aperture.

16. A dispenser according to claim 2, wherein the lid sealingly covers the tissue dispensing aperture and the manipulating opening.

17. A dispenser according to claim 1, wherein the tissue dispensing aperture and the manipulating opening with are initially sealable by a foil extending thereover.

18. A dispenser according to claim 1, wherein the manipulating opening is hinged by integral hinge portions extending at sides of the tissue dispensing aperture.

19. A dispenser according to claim 1, wherein the manipulating opening is closed by two flaps extending towards one another.

20. A dispenser according to claim 1, wherein one of the flap and an edge of the manipulating opening are formed with an engaging member to prevent unintended deformation of the flap upon pulling a tissue through the tissue dispensing aperture.

21. A dispenser according to claim 1, wherein the tissue dispensing aperture has a Y-like shape.

22. A tissue package fitted with a dispenser according to claim 1.

23. A tissue package cover fitted with a dispenser according to claim 1.

24. A rigid cover engageable with a tissue box, said cover fitted with a dispenser comprising a tissue dispensing aperture and a manipulating opening different from said dispensing aperture, both opening into a tissue-containing space of the box;

said tissue dispensing aperture is sized for dispensing one tissue at a time while separating a duty tissue from a successive tissue; and further comprising at least one flap for normally closing said manipulating opening while maintaining open said dispensing aperture, and for selectively opening said manipulating opening to allow introduction of a user's fingers into the tissue-containing space, wherein at least a portion of said dispensing aperture is comprised on the or each said flap, wherein the or each said flap is hinged by hinged portions extending at sides of the tissue dispensing aperture, and wherein said tissue dispensing aperture and the manipulating opening are covered by a lid.

25. A cover according to claim 24, wherein the manipulating opening of the dispenser is integrally molded with the cover.

26. A tissue package comprising a dispenser fitted with a tissue dispensing aperture and a manipulating opening different from said dispensing aperture, both opening into a tissue-containing space of the package;

said tissue dispensing aperture is sized for dispensing one tissue at a time while separating a duty tissue from a successive tissue; and further comprising at least one flap for normally closing said manipulating opening while maintaining open said dispensing aperture, and for selectively opening said manipulating opening to allow introduction of a user's fingers into the tissue-containing space, wherein at least a portion of said dispensing opening is comprised on the or each said flap, wherein the or each said flap is hinged by hinged portions extending at sides of the tissues dispensing aperture, and wherein said tissue dispensing aperture and the manipulating opening are covered by a lid.

27. A dispenser according to claim 1, wherein the tissue dispensing aperture is deformable to allow introduction of a user's fingers into the tissue-containing space.

28. A dispenser according to claim 1, wherein said dispensing opening is defined by a perimeter, and wherein said flap comprises a part of said perimeter.

29. A cover according to claim 25, wherein said dispensing opening is defined by a perimeter, and wherein said flap comprises a part of said perimeter.

30. A tissue package according to claim 26, wherein said dispensing opening is defined by a perimeter, and wherein said flap comprises a part of said perimeter.

* * * * *